United States Patent [19]

Melin et al.

[11] 4,235,378

[45] Nov. 25, 1980

[54] WATER PLAY TOY

[75] Inventors: Arthur K. Melin; Richard L. Gillespie, both of San Gabriel; Darle L. Kerkenbush; Jim L. Whittington, both of Diamond Bar; Douglas A. Geller, Monrovia, all of Calif.

[73] Assignee: Wham-O Mfg. Co., San Gabriel, Calif.

[21] Appl. No.: 58,069

[22] Filed: Jul. 16, 1979

[51] Int. Cl.[3] ..... B05B 3/00

[52] U.S. Cl. ..... 239/229; 46/41

[58] Field of Search ..... 239/229, 243, DIG. 12; 46/92, 41

[56] References Cited

U.S. PATENT DOCUMENTS

| | | | |
|---|---|---|---|
| 374,960 | 12/1887 | Gumaer | 239/229 |
| 2,634,545 | 4/1953 | Gertz | 46/41 |
| 2,757,960 | 8/1956 | Hatcher | 239/229 |
| 2,954,932 | 10/1960 | Albano | 239/229 X |
| 3,079,727 | 3/1963 | Melin | 239/229 X |

*Primary Examiner*—Richard A. Schacher

*Attorney, Agent, or Firm*—Christie, Parker & Hale

[57] ABSTRACT

A water play toy shaped in the form of an animal or cartoon character in which the body is provided with an outlet section which has a plurality of flexible hollow tubes attached to water outlets spaced around the outlet section. A source of water under pressure is coupled to a conduit passing through the body and communicates with the outlet section for distributing water to the hollow tubes. When the water pressure is turned on, a plurality of individual jets of water are emitted by the individual tubes. Because the tubes are flexible they writhe and twist in a random motion pattern due to the action and reaction forces of the water acting on the tubes. In one embodiment a first enclosed chamber compresses the outlet section. A second enclosed chamber is built into the upper interior portion of the first chamber which communicates with a small pinhole-type outlet to provide a misting or fogging aspect to the overall water pattern emitted by the water play toy. As long as water pressure is uninterrupted water continues to flow through the flexible lines and the fogger creating a pattern of small waving streams of water within which a heavy mist pattern of water droplets is interspersed. The result is around 360° pattern of water distribution around the toy.

15 Claims, 13 Drawing Figures

WATER PLAY TOY

BACKGROUND OF THE INVENTION

The present invention relates to water play toys and in particular to a water emitting device combining animation and action with excellent water dispersion in a sizeable area around the toy. The invention provides an assembly in which the top or upper portion has a plurality of hollow tubes attached to it which in operation writhe and twist as water is communicated to them to produce a spherical pattern of water surrounding the toy and covering a radius of approximately ten feet in all directions.

The device according to the present invention is one which operates primarily on the principle of action and reaction, the principle which causes the writhing of a hose when water is communicated thereto. By connecting a source of water under pressure to an inlet to the toy and a plurality of hollow flexible tubes at the outlet side of the toy a plurality of streams or jets or water are created which are directed generally upwardly and outwardly from each of the individual tubes extending from the body of the toy.

The concept of using the action/reaction principle created by the application of fluid pressure to a flexible line has been used extensively in the past. Representative of the foregoing, are the devices described in U.S. Pat. Nos. 3,633,826; 2,930,531; 2,608,438; 2,757,960; 1,939,461; 212,368 and 374,960 and British Pat. No. 753,004. The foregoing patents relate to liquid sprinkling devices and are intended for use as lawn or garden sprayers. All involve the provision of a means of supplying water to one or more flexible tubes. One end of the flexible tube or tubes is held or anchored in position so that when water is supplied the flow of water into and through the discharge tube(s) caused them to flex and writhe in a random manner. In some instances the patents refer to the fact that the result is a novel, interesting, or decorative lawn piece. In this connection, please refer to U.S. Pat. Nos. 1,939,461, 212,368, and 374,960.

Water action/reaction toys are also known. An example is the "Jet Propelled Toy" in U.S. Pat. No. 3,079,727. The action/reaction principle is utilized by the provision of an orifice which produces a jet of water to in turn cause an elongated flexible hose to writhe like a snake and to propel itself upwardly when a source of water pressure is connected to it.

SUMMARY OF THE PRESENT INVENTION

Toys which combine an active mechanism and also involve the use of water have historically been items of excellent play value which continue to hold the interest of the users far beyond the initial novelty of the attraction. Particularly in summer months, such toys are not only a source of amusement and recreation, but they are also enjoyable in a physical sense because of the cooling effect of the water sprays emanating therefrom and the evaporative cooling experienced by the users. The present invention utilizes the above aspects and introduces an animation affect as well. The animation combined with the random pattern of motion of each of the water emitting hollow tubes results in an apparatus in which the play value and amusement value of the toy is significantly enhanced.

This random motion is attained by the use of the plurality of hollow tubes to which water under pressure is supplied. One end of each of the tubes is secured to the device while the opposite ends are completely free of any attachment. By supplying water under pressure to the device, an envelope of water is created from a plurality of randomly gyrating thin water streams and supplemented by a fine mist or spray from a central fogging element to create, in effect, a water sphere of streams, drops and droplets of water which surrounds and extends outwardly from the unit to create a sphere of about ten feet in diameter which may be increased or decreased by varying the available water pressure.

Briefly, the invention provides a water play toy comprising a housing having an inlet coupling, the housing forming a first chamber. A source of water is connected to the housing at the inlet coupling and a conduit extends through the housing from the inlet coupling to an outlet location. A second chamber is located within the first chamber at the outlet location from the housing communicating with the conduit and a plurality of individual outlets from the second chamber are provided which open to the exterior of the housing. A plurality of flexible hollow tubular means are secured to each of the individual outlets at one end and the opposite ends are completely free and unfettered.

The location and arrangement of the chamber and the individual outlets is chosen such that the direction of fluid emitted is generally upward and outward. In operation, the source of fluid under pressure may be an ordinary garden hose connected to a household water supply. The communication of water to the individual flexible hollow tubular means causes these tubes to flex and writhe like the untethered end of a garden hose. When the toy is designed in the presently preferred form of a bug with the tubes attached to the top portion of the head, the action of the tubes creates a visual effect of the writhing of antennae or feelers. In its presently preferred embodiment the toy of the present invention is configured so as to have a hat or caplike device secured on top of the head. A plurality of outlets are provided in the top of the cap and a plurality of flexible hollow tubes 10–20 inches in length are connected to the outlets. Likewise in the center top of the cap a tertiary chamber is located interiorly of secondary chamber to which water is admitted in a swirling pattern because of the configuration of the tertiary chamber. The swirling flow of water toward an aperture in the tertiary chamber thereto creates a significant fogging or misting effect to be emitted from the aperture.

Using normally available water pressures, the water pattern can be distributed up to a radius of five to ten feet in all directions from the water bug device and broadcast in a generally spherical pattern. In the presently preferred embodiment, a plurality of six hollow tubes are provided. What results is a water toy which provides great fascination and entertainment value for its users by virtue of its action and animation aspects and its broadcast of a substantial envelope of water. The large diameter of the pattern of water which is produced makes the toy particularly suitable for group play.

DESCRIPTION OF THE DRAWINGS

These and other advantages of the present invention will be better understood by reference to the drawings wherein.

DESCRIPTION OF A SPECIFIC EMBODIMENT

Figure 1:
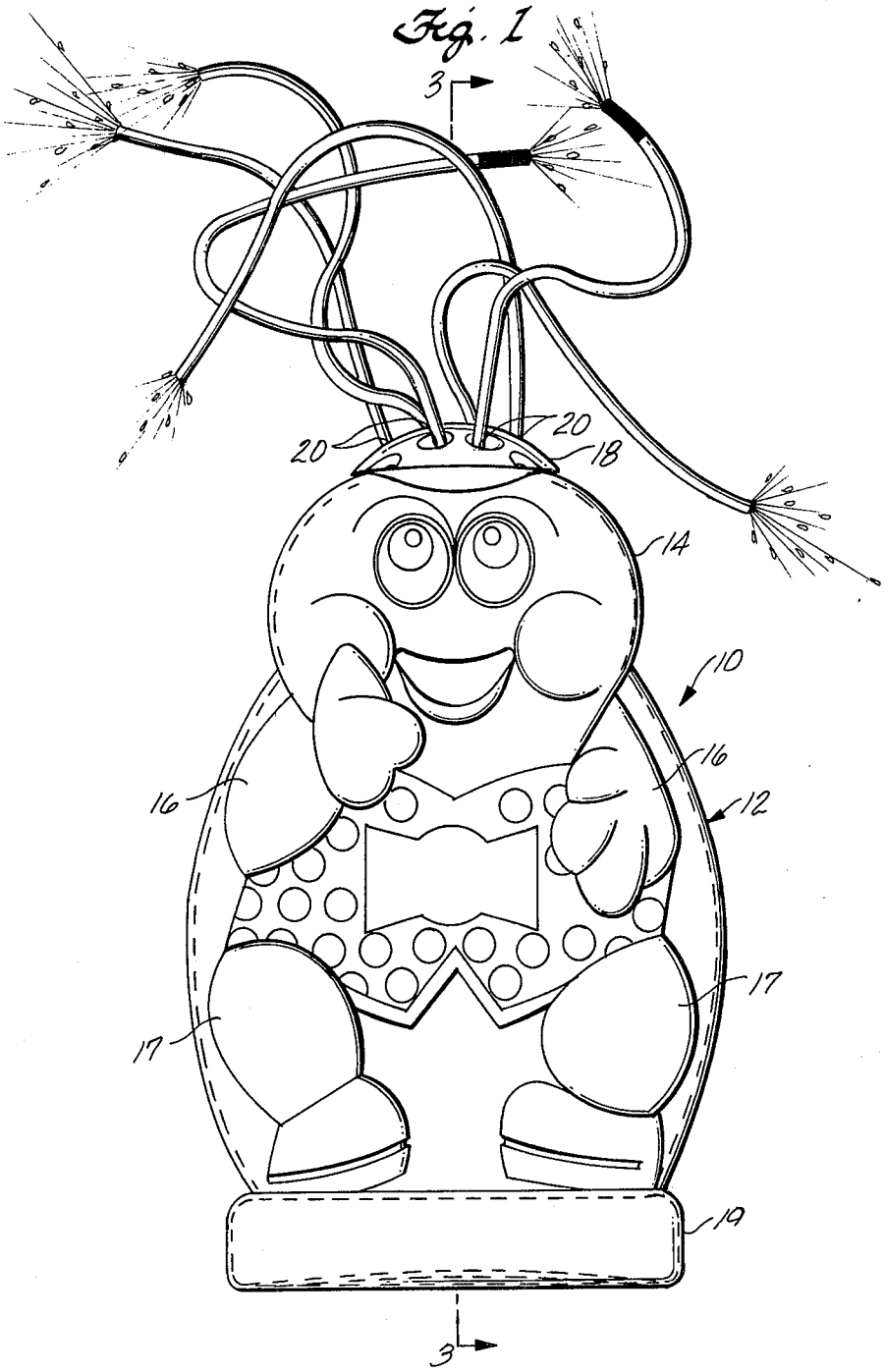
FIG. 1 is a front elevation view of the toy according to the present invention showing a plurality of flexible tubes extending upwardly from the toy in a writhing orientation as they appear when water is communicated thereto.

A front elevation view of a water toy 10 according to the present invention is shown in FIG. 1. As shown therein, the presently preferred embodiment of the toy is in the form of a highly stylized caricature of a bug and comprises a molded housing 12 having a head 14, arms 16, and legs 17 formed therein. Attached at the bottom of the housing is a circular base 19 integrally formed with housing 12 for standing the toy on the ground or other surface.

A cap 18 is attached at the top of head portion 14 having a plurality of apertures 20 spaced around the periphery of the cap. Attached to the apertures by means of a friction fit or by bonding is a plurality of flexible tubes 22 as they appear when writhing and twisting as water is supplied to the toy.

Figure 2:
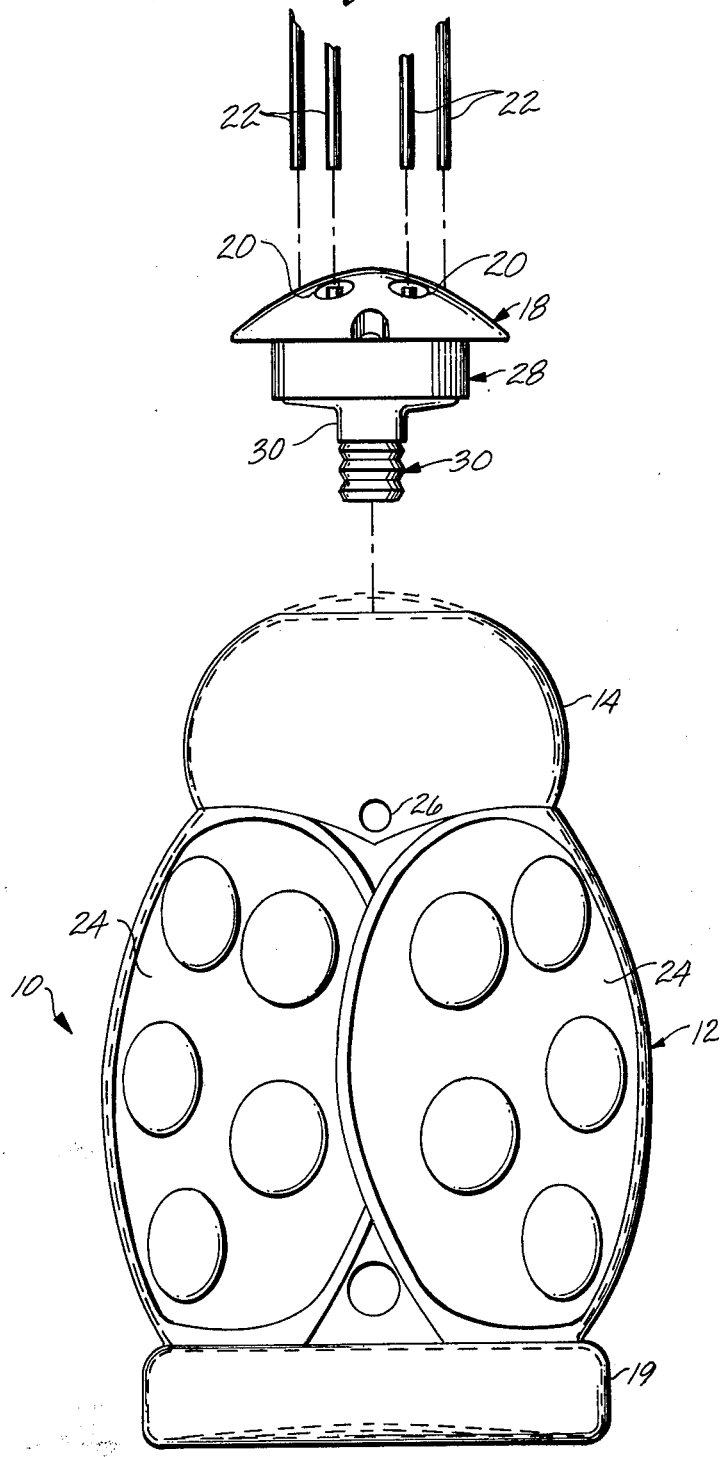
FIG. 2 is an exploded view of the rear of the toy showing the housing, a secondary chamber which is secured to the top of the housing and the plurality of flexible tubes which connect to outlets from the secondary chamber.

The view in FIG. 2 is an exploded rear view of the toy according to the present invention showing the housing 10 with cap portion 18 spaced above housing 10 and flexible tubes 22 likewise spaced and positioned above the apertures 20 into which they are inserted and engaged when the unit is assembled. As can be seen from FIG. 2, the rear of the toy is molded to depict a pair of folded wings 24. Also provided at the rear of the base of the head is a fill hole 26 for enabling the user to add water to the interior of the housing to provide ballast to the toy making it more stable when in use so that it cannot be easily knocked over or kicked over accidentally. Cap portion 18 includes a body portion 28 and a hose fitting portion 30 and is described in greater detail in conjunction with FIGS. 4 & 5.

Figure 3:
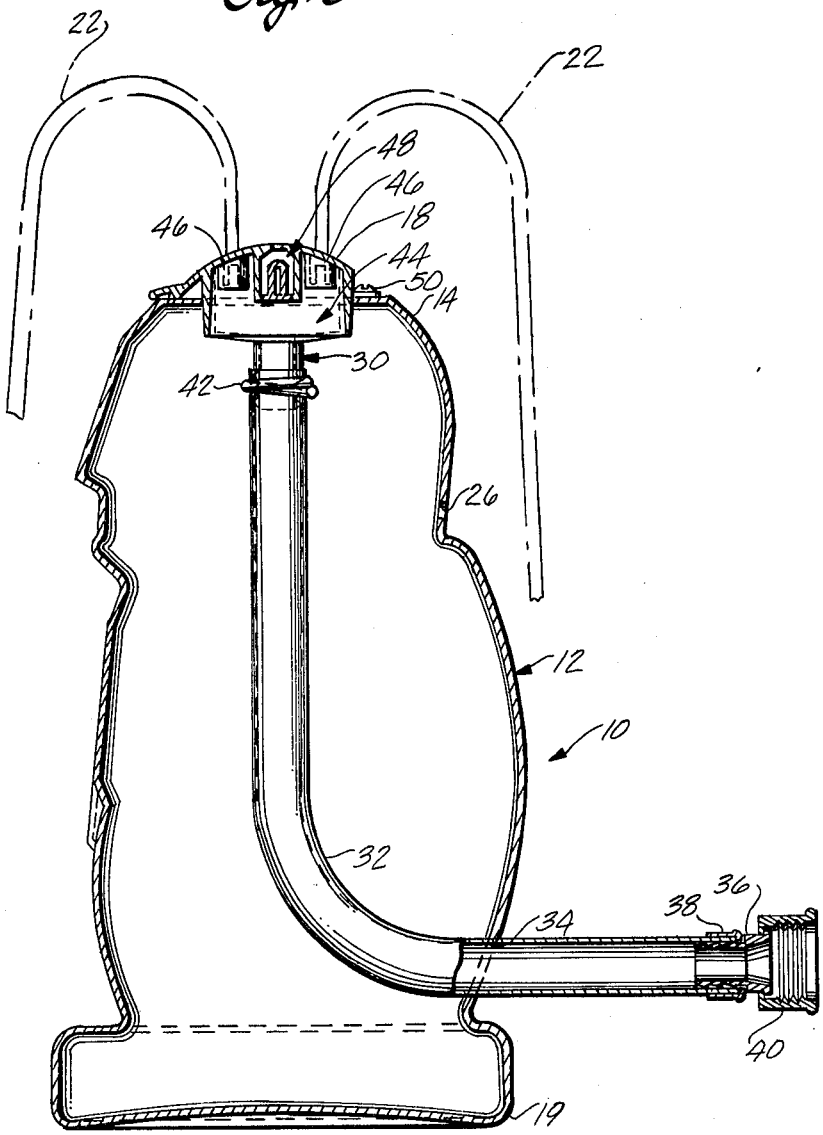
FIG. 3 is a sectional view taken through the housing (along lines 3—3 of FIG. 1) showing the inlet coupling, the conduit extending through the housing between the inlet and the secondary chamber and the cross-section of the secondary and tertiary chambers located within the housing.

The internal arrangement of the toy according to the present invention is shown in the section view of FIG. 3. A flexible hose 32 extends between cap portion 18 through an aperture 34 at the lower rear of housing 12 to the exterior thereof. Housing 12 defines a first chamber of the toy according to the present invention. The portion of hose 32 located externally of the housing comprises a fitting 36 which is frictionally engaged with the hose 32 and held in place by a ferrule 38 which is clamped about the fitting-hose assembly. A rotatable coupling 40 engages the exterior end of fitting 36 to provide the means whereby the toy is coupled to a garden hose or other water supply source.

At its opposite end, hose 32 is friction fitted to the knurled end of fitting 30 and clamped thereto by means of hose clamp 42. Located within the interior of cap 18 is a chamber 44 which communicates with the conduit defined by fitting 30 on the interior or housing side of the cap and with a plurality of nozzles 46 located within apertures 20 which communicate to the exterior of the cap and to which the flexible lines 22 are friction fitted or bonded. Another chamber 48 communicates with chamber 44 and the details of this chamber will be more completely described in conjunction with the description of FIGS. 5 and 6A, B and C. As shown, the interior of housing 12 is hollow and can be weighted or ballasted by introduction of water into the interior of the housing through fill hole 26.

Figure 4:
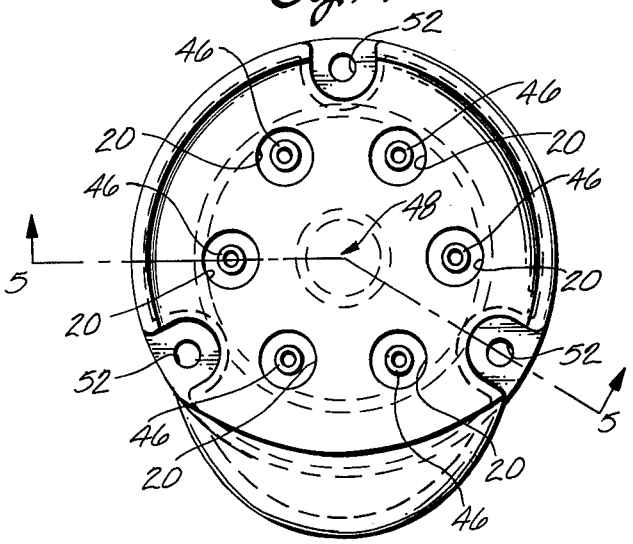
FIG. 4 is a top view of the cap according to the present invention.
Figure 5:
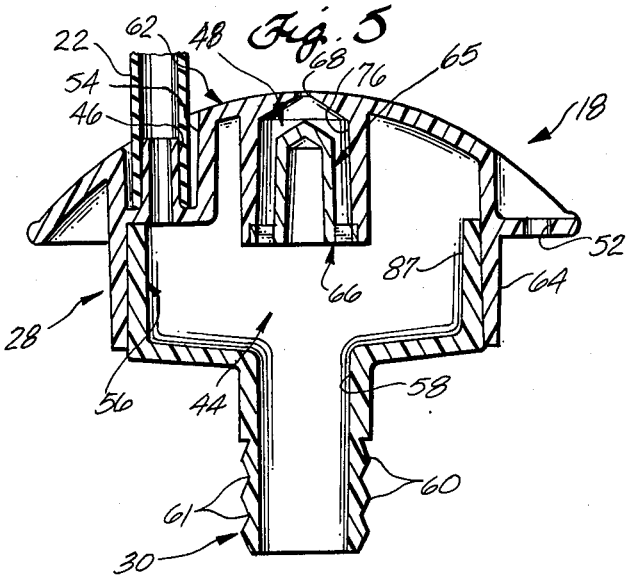
FIG. 5 is a view taken along the lines 5—5 of FIG. 4.

Cap 18 is secured to the top of housing 12 by means of threaded or other type fasteners 50 which are located at spaced intervals around the periphery of the cap. As shown in FIG. 4, three apertures 52 are provided for receiving fasteners 50 which threadedly or otherwise engage apertures which are provided in the top of housing 12 in mating registration with apertures 52. As seen in FIGS. 4 & 5, the number of individual nozzles 46 which communicate with the exterior of the cap are 6 in total in the presently preferred embodiment and are located within circumscribing apertures or recesses 20. The upstanding portion of nozzles 46 are wholly contained within the recesses 20 so that the external surface of cap 18 is smooth and without any surface projections which might pose a safety hazard to users of the toy. The central location of chamber 48 is shown in ghosted outline in FIG. 4.

Further details of the cap assembly 18 are shown in the sectional view taken along lines 5—5 of FIG. 4. As shown therein, body portion 28 comprises a circular cup-shaped portion having a conduit 58 opening from the bottom of the cup. Conduit 58 is provided with a plurality of annular ridges 60 and depressions 61 on the exterior surface thereof to define a knurled fitting 30 for good frictional engagement with hose 32 when the hose is attached to the fitting. Seated over cup-shaped portion 56 is a top portion 62 having a circular downwardly extending flange or skirt 64 which, when seated on cup-shaped portion 56 is arranged such that flange 64 overlaps the upwardly extending sides of the cup-shaped portion 56 and defines a chamber 44 located internally of cap 18 to which water is admitted prior to being collected and emitted externally of cap portion 18 through nozzles 46. Cup-shaped portion 56 is secured to top portion 62 by bonding the mating surfaces of flange 64 and side wall 87 of portion 56 by means of a suitable adhesive or other bonding agent.

The recessed configuration of nozzles 46 within recesses 20 is more clearly shown in FIG. 5 and shown engaged with one of the nozzles 46 is a flexible tube 22 illustrating the manner in which tubes are engaged with the nozzles. The engagement is secured by a friction fit or by bonding with the tube being forced onto and about the neck of the nozzle to the base of recess 20. Top portion 62 defines a chamber 48 into which is received and seated a flow director 66. Located at the top of chamber 48 is a small aperture 68 communicating between chamber 48 and the exterior of cap portion 18.

Figure 6B:
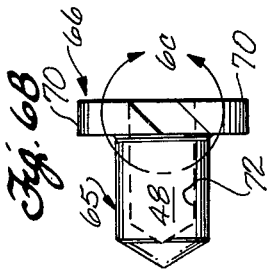
FIG. 6B is a side view of the flow director.
Figure 6C:
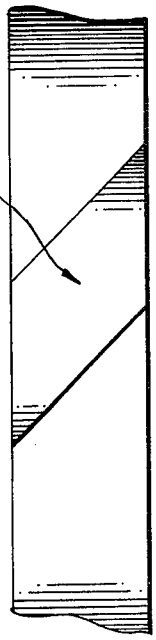
FIG. 6C is an enlarged view of the area enclosed by circle 6C in FIG. 6B.
Figure 6A:
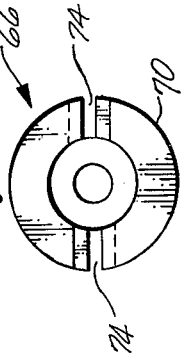
FIG. 6A is a top view of a flow director located in the teritary chamber.

The details of the flow director 66 are shown in FIGS. 6A, 6B and 6C. The flow director is a generally cylindrical element 65 having a circular flanged base 70 integrally formed therewith. Cylinder 65 has a hollow interior 72 and the exterior surface thereof is shaped so as to correspond generally to the configuration of chamber 48 into which it is placed. A pair of slots 74 extend through flange 70 in an angular or slanted direction. An enlarged view of slot 74 is shown in FIG. 6C. Water in chamber 44 passes through slots 74 into the space 76 defined between the exterior of flow director 66 and the interior walls of chamber 48. The slanted configuration of slots 74 cause the water introduced into the space to flow in a swirling, circular pattern in the chamber ascending toward aperture 68 and is emitted from aperture 68 in the form of a fine mist or droplets to provide a source of water of a very fine consistency in comparison to the larger and more grossly sized drops of water which are emitted from the flexible tubes 22. The slanted configuration of slots 74 enhance and assist in creating a swirling flow pattern through the chamber such that the water flows angularly through aperture 68 rather than directly at the aperture, thereby enhancing the fogging or misting capabilities of the device.

Figure 7A:
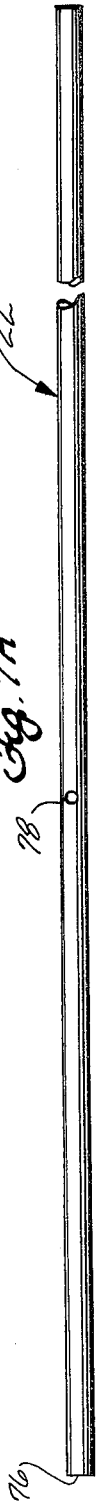
FIG. 7A is a side view of one of the flexible tubes connected to the outlets from the cap.
Figure 7B:
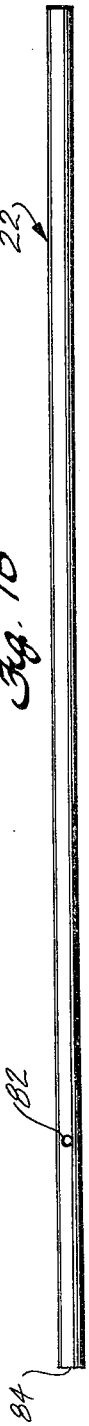
FIG. 7B is a side view of an alternate embodiment of the flexible tube which is particularly suited for connection to the outlets located at the front of the cap.

The side view of the flexible tubes 22 shown in FIGS. 7A and 7B illustrate the presently preferred embodiments of the tubes. The tubes, which are extended to act like or simulate the antennae or feelers of a bug are of two lengths. Those at the rear of the water toy are shown in FIG. 7A and are preferably 18 inches in length. Shown located at a distance of approximately 6 inches from the outlet end 76 of tube 22 is an aperture 78. Apertures such as aperture 78 are provided in the tubes on both sides at a pre-determined distance from the end to dampen the whipping or whip-cracking action of the tubes when water is supplied thereto and, thus, make the writhing action of the tubes a more gently oscillating one.

The presently preferred embodiment of the tubes provided at the front of the cap is shown in FIG. 7B. In this case, a pair of apertures 82 are provided at a distance of approximately two inches from the outlet end 84 of the tube which is preferably 12 inches in length. By moving the location of the intermediate aperture closer to the outlet end of the tube, an increase in the whipping action and movement of the tube is produced. In addition to reducing the strength of the writhing action of the tubes, the intermediate apertures 78, 82 also provide for better water dispersion and different size water drops to be obtained from the toy.

Figure 8:
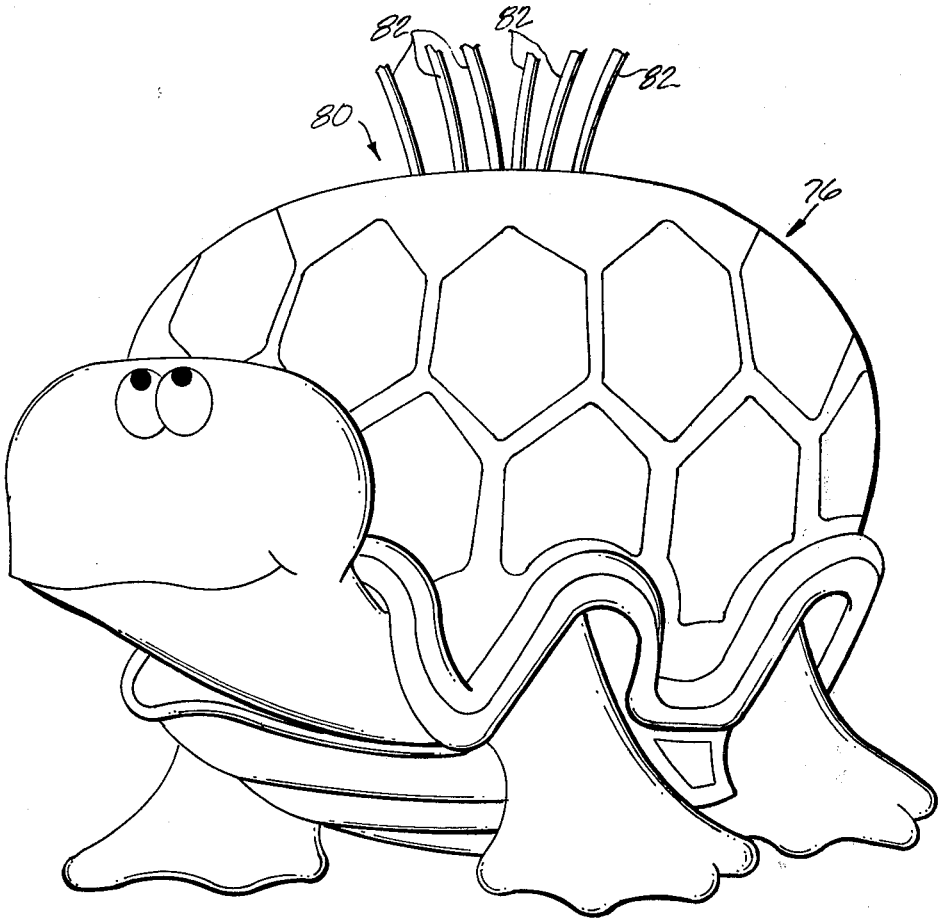
FIG. 8 is a front elevation view of an alternate embodiment of a toy created according to the present invention.
Figure 10:
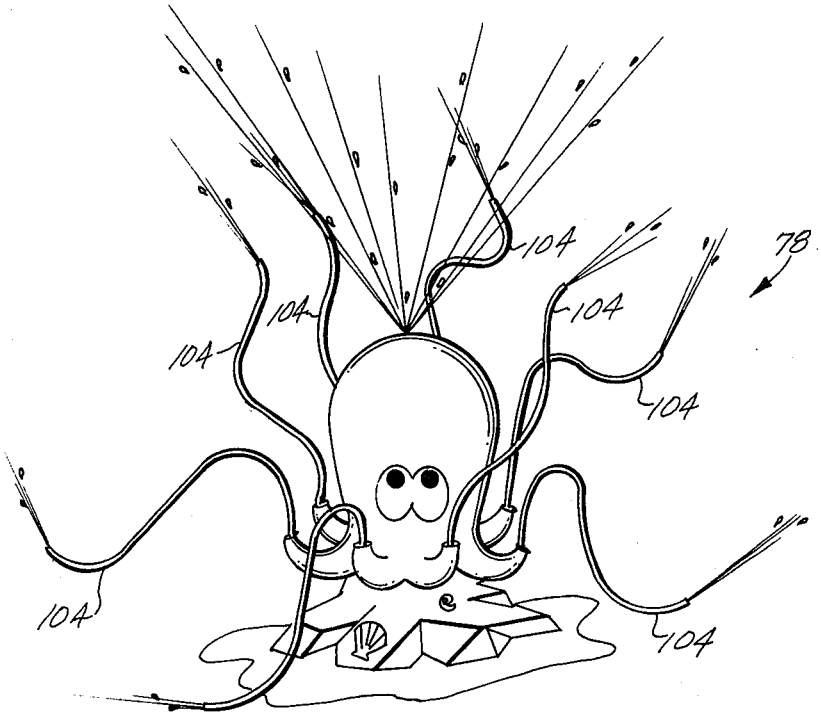
FIG. 10 is a front elevation view of another alternate embodiment of a toy character according to the present invention.

A number of creature, character and object forms are suitable for adaptation in the present invention. Two such embodiments are illustrated in FIGS. 8 and 10 these being a turtle 76 and octopus 78 respectively. To enhance their play value, the creatures are rendered in a comic or cartoon like aspect. As in the case of the water bug of FIGS. 1–3, the turtle apparatus 76 has a hollow interior defining a first chamber and an outlet section 80 located at the top of the turtle's back communicating with the first chamber.

Figure 9:
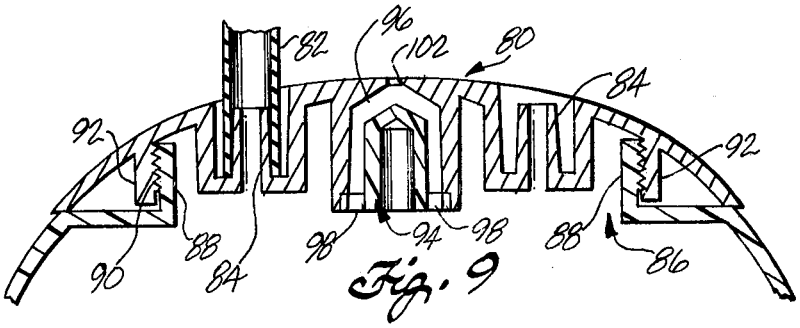
FIG. 9 is a sectional view of an alternate embodiment of the outlet section according to the present invention.

The details of outlet section 80 are shown in the section view of FIG. 9. A plurality of tubes 82 are connected to nozzles 84. In this embodiment, the turtle's back is formed with a circular opening 86 in the top thereof with upwardly extending wall 88 having an external screw thread 90 formed therein. Outlet section 80 is congruently formed with a screw threaded flange 92 located on the concave side of the section to engage screw thread 90 whereby outlet section 80 is rotatably attached and detached from the apparatus. In this embodiment the interior of the housing is entirely filled with water and communicates directly with nozzles 84 and flow director 94. Flow director 94 is secured into a chamber 96 and slanted slots 98 pass water into chamber 96 and upwardly in a swirling pattern to a fogging aperture 102.

In the embodiment shown in FIG. 10, outlet tubes 104 are spaced around the body of the octopus 78. A misting and fogging aperture 106 is located in the top of the head. To supply water to tubes 104 and aperture 106, a flow diverter (not shown) is provided interiorly of the octopus housing to direct a portion of the water supply to a concentrator for supplying tubes 104 and the balance to a chamber utilizing a flow director as previously described and illustrated.

In addition to the forms illustrated herein, it is also contemplated that the form of the apparatus of the present invention could have a number of other shapes including a fire hydrant, a frog or any other animal or cartoon character carrying an umbrella.

What is claimed is:

1. A water play toy comprising:

a housing having an inlet coupling, said housing forming a first chamber;

a source of water connected to the housing at the inlet coupling;

a conduit extending through the housing from the inlet coupling to an outlet location;

a second chamber located within the first chamber at the outlet location from the housing, said chamber communicating with the conduit;

a plurality of individual outlets from the second chamber opening to the exterior of the housing; and a plurality of flexible hollow tubular means secured to each of the individual outlets at one end thereof with the opposite ends being free.

2. A toy according to claim 1 including a third chamber located within said second chamber, said third chamber communicating with an aperture opening to the exterior of the housing.

3. A toy according to claim 2 including means for supplying water to said third chamber.

4. A toy according to claim 3 wherein the supply means is a flow director disposed within the third chamber, said flow director defining means for communicating water from the second chamber to the third chamber.

5. A toy according to claim 4 wherein the flow director is symmetrical to the interior of the third chamber and is provided with a base defining a circular flange extending around the periphery of the flow director.

6. A toy according to claim 5 wherein the communicating means in the flow director are slanted slots passing through the circular flange.

7. A toy according to claim 6 wherein the flow director is generally cylindrical in configuration and defines a space between the interior of the third chamber and the exterior of the flow director communicating between the slots in the circular flange and the aperture to the exterior of the housing.

8. A toy according to claim 1 including an outlet portion secured to the top of the housing at the outlet location, said outlet portion defining the second chamber.

9. A toy according to claim 8 wherein the outlet portion is a cap secured to an opening in the top of the housing.

10. A toy according to claim 9 wherein the outlet nozzles are located within recesses spaced around the exterior of the cap.

11. A toy according to claim 10 wherein the tubular means are flexible tubes secured to the nozzles by fitting one end of each tube about its respective nozzle.

12. A toy according to claim 11 wherein the tubes are provided with at least one aperture intermediate their ends for emitting water therefrom.

13. A toy according to claim 12 wherein the intermediate aperture is located at a predetermined distance from the free end of the tube to control the writhing action of the tube when water is supplied thereto.

14. A toy according to claim 8 wherein the outlet portion is secured to the housing by means of fasteners.

15. A toy according to claim 8 wherein the outlet portion is secured to the housing by a screw threaded engagement.

* * * * *